US011136821B2

(12) United States Patent
Smith et al.

(10) Patent No.: US 11,136,821 B2
(45) Date of Patent: Oct. 5, 2021

(54) OPERATING SYSTEM FOR AN ARCHITECTURAL-STRUCTURE COVERING

(71) Applicant: Hunter Douglas Inc., Pearl River, NY (US)

(72) Inventors: Stephen P. Smith, Sandy Springs, GA (US); Nicholas Buccola, Gastonia, NC (US)

(73) Assignee: HUNTER DOUGLAS INC., Pearl River, NY (US)

( * ) Notice: Subject to any disclaimer, the term of this patent is extended or adjusted under 35 U.S.C. 154(b) by 451 days.

(21) Appl. No.: 16/136,470

(22) Filed: Sep. 20, 2018

(65) Prior Publication Data

US 2019/0100962 A1 Apr. 4, 2019

Related U.S. Application Data

(60) Provisional application No. 62/570,713, filed on Oct. 11, 2017, provisional application No. 62/565,442, filed on Sep. 29, 2017.

(51) Int. Cl.
*E06B 9/322* (2006.01)
*E06B 9/78* (2006.01)
(Continued)

(52) U.S. Cl.
CPC ..... *E06B 9/78* (2013.01); *E06B 9/34* (2013.01); *E06B 9/42* (2013.01); *E06B 9/264* (2013.01); *E06B 2009/2435* (2013.01)

(58) Field of Classification Search
CPC ..... E06B 9/34; E06B 9/32; E06B 9/78; E06B 9/322; E06B 9/326; E06B 9/38;
(Continued)

(56) References Cited

U.S. PATENT DOCUMENTS 1,118,033 A 11/1914 McCloud
6,129,131 A 10/2000 Colson
(Continued)

FOREIGN PATENT DOCUMENTS

EP 2208852 A2 7/2010
WO 2014/034971 A1 † 3/2014

OTHER PUBLICATIONS

European Search Report and Written Opinion for the European Patent Application No. EP18196087, dated May 29, 2019, 13 pages.

*Primary Examiner* — Daniel P Cahn
(74) *Attorney, Agent, or Firm* — Kacvinsky Daisak Bluni PLLC

(57) ABSTRACT

An improved operating system for use in an architectural-structure covering for extending and retracting a covering portion is disclosed. The operating system including an operating element for raising the covering portion and for transitioning the operating system between a retraction mode to raise the covering and an extension mode to lower the covering. To transition between the retraction and extension modes, an operator may move the operating element in a preset direction, such as, in the manner akin to a switch. For example, moving the operating element in a first direction (e.g., a rearward direction away from the operator) shifts the operating system into the retraction mode, while moving the operating element in a second direction (e.g., a forward motion toward the operator) shifts the operating system into the extension mode. In one embodiment, the first and second directions may be transverse to a longitudinal axis of the architectural-structure covering.

7 Claims, 15 Drawing Sheets

(51) Int. Cl.

| | |
|---|---|
| ***E06B 9/34*** | (2006.01) |
| ***E06B 9/42*** | (2006.01) |
| *E06B 9/24* | (2006.01) |
| *E06B 9/264* | (2006.01) |

(58) Field of Classification Search
CPC .... E06B 9/262; E06B 9/30; E06B 2009/2627; E06B 2009/3222; E06B 2009/785
See application file for complete search history.

(56) References Cited

U.S. PATENT DOCUMENTS

| | | | | |
|---|---|---|---|---|
| 6,201,364 | B1 | 3/2001 | Will et al. | |
| 7,128,126 | B2 | 10/2006 | Smith et al. | |
| 7,159,635 | B2 | 1/2007 | Holt et al. | |
| 7,228,797 | B1 | 6/2007 | Hillman et al. | |
| 7,578,334 | B2 | 8/2009 | Smith et al. | |
| 8,186,413 | B2 | 5/2012 | Fujita et al. | |
| 9,890,588 | B2 | 2/2018 | Smith | |
| 10,407,983 | B2 * | 9/2019 | Holt | E06B 9/34 |
| 10,538,963 | B2 * | 1/2020 | Anthony | E06B 9/326 |
| 10,544,621 | B2 * | 1/2020 | Mocanu | E06B 9/44 |
| 10,851,587 | B2 * | 12/2020 | Anthony | E06B 9/34 |
| 2004/0226663 | A1 * | 11/2004 | Smith | E06B 9/68 160/84.05 |
| 2006/0118248 | A1 | 6/2006 | Anderson et al. | |
| 2006/0272783 | A1 * | 12/2006 | Smith | E06B 9/262 160/121.1 |
| 2008/0202709 | A1 * | 8/2008 | Anderson | E06B 9/34 160/321 |
| 2009/0120593 | A1 | 5/2009 | Lesperance | |
| 2010/0018656 | A1 * | 1/2010 | Fujita | E06B 9/34 160/319 |
| 2013/0025805 | A1 | 1/2013 | Lin | |
| 2013/0220561 | A1 | 8/2013 | Yu et al. | |
| 2014/0166218 | A1 * | 6/2014 | Ng | E06B 9/42 160/120 |
| 2014/0216668 | A1 * | 8/2014 | Kim | E06B 9/56 160/322 |
| 2015/0007946 | A1 | 1/2015 | Yu et al. | |
| 2015/0368968 | A1 * | 12/2015 | Smith | E06B 9/62 160/311 |
| 2017/0006740 | A1 * | 1/2017 | Holt | E06B 9/72 |
| 2017/0241198 | A1 * | 8/2017 | McNeill | E05F 11/04 |
| 2017/0268293 | A1 * | 9/2017 | de Vries | E06B 9/42 |
| 2018/0112461 | A1 * | 4/2018 | Holt | E06B 9/78 |
| 2018/0119489 | A1 | 5/2018 | Smith | |
| 2018/0301916 | A1 * | 10/2018 | Nien | E06B 9/24 |
| 2019/0100962 | A1 * | 4/2019 | Smith | E06B 9/34 |
| 2020/0332595 | A1 * | 10/2020 | Anthony | E06B 9/72 |

* cited by examiner
† cited by third party

OPERATING SYSTEM FOR AN ARCHITECTURAL-STRUCTURE COVERING

CROSS-REFERENCE TO RELATED APPLICATIONS

This is a non-provisional of, and claims the benefit of the filing date of, U.S. provisional patent application No. 62/565,442, filed Sep. 29, 2017, titled "Operating System for an Architectural-Structure Covering", and is a non-provisional of, and claims the benefit of the filing date of, U.S. provisional patent application No. 62/570,713, filed Oct. 11, 2017, titled "Operating System for an Architectural-Structure Covering", the entirety of which applications are incorporated by reference herein.

FIELD OF THE DISCLOSURE

The present disclosure relates generally to the field of architectural-structure coverings, and relates more particularly to methods and apparatuses for operating a covering for an architectural structure.

BACKGROUND

Architectural-structure coverings may selectively cover an architectural structure such as, for example, a window, a doorway, a skylight, a hallway, an archway, a portion of a wall, etc. Generally speaking, architectural-structure coverings may include a covering that can be extendable and retractable, for example, vertically extendable or retractable (e.g., able to be lowered or raised, respectively, in a vertical direction) relative to a horizontally-oriented head rail between an extended position and a retracted position for obscuring and exposing the underlying architectural structure. The architectural-structure covering may further include a bottom rail attached to a lower edge of the covering. The bottom rail may be utilized to add weight along the lower edge of the covering to encourage the covering to drop by gravity during deployment. In addition, the bottom rail may be engaged by the user to move the covering between the extended and retracted positions, or to provide an aesthetic finish to an end of the covering.

To move the covering between the extended and retracted positions, some architectural-structure coverings include a rotatable member (e.g., a roller) about which the covering may be wrapped to retract the covering (e.g., the retracted configuration), and unwrapped to extend the covering (e.g., the extended configuration). In use, rotation of the rotatable member in a first direction may retract the covering while rotation of the rotatable member in a second, opposite direction may extend the covering. The rotatable member generally extends between two opposing end caps, and the covering portion of the architectural-structure covering may wrap around the rotatable member or be gathered or stacked adjacent to the rotatable member. For example, some retractable coverings include a flexible covering suspended from the rotatable member. The covering can either be wrapped about the rotatable member to retract the covering or unwrapped from the rotatable member to extend the covering. As another example, some retractable coverings, such as Venetian blinds, include a plurality of slats that are raised or lowered as lift cords are wrapped about or unwrapped from the rotatable member. In other embodiments, the covering portion of the architectural-structure covering may be stacked adjacent to the rotatable member. For example, the architectural-structure covering may include lift cords which are coupled to the covering portion and the rotatable member. In use, rotation of the rotatable member in a first direction wraps the lift cords about the rotatable member causing the covering portion to retract adjacent to the rotatable member while rotation in a second direction causes the lift cords to unwrap about the rotatable member causing the covering portion to move in an extended configuration. Regardless of the form of the retractable covering, rotation of the rotatable member generally causes movement of the covering of the architectural-structure covering. To actuate movement of the rotatable member, and thus the covering of the architectural-structure covering, an operating system may be operably coupled to the rotatable member.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is an operating system for use in an architectural-structure covering for extending and retracting a covering portion of the architectural-structure covering. The covering portion may be any covering now known or hereafter developed. For example, the covering may be a flexible material which, in use, is capable of being extended or moved away from the rotatable member in an extended position, and retracted in a retracted position. The operating system may include an operating element (e.g., a cord, a ball chain, etc.) for retracting or raising the covering portion, and for switching, moving, or transitioning (used interchangeable herein without the intent to limit) the operating system between a retraction mode to retract or lift the covering of the architectural-structure covering and an extension mode to extend or lower the covering of the architectural-structure covering.

To transition between the retraction and extension modes, an operator may move the operating element in a preset direction, such as, in a manner akin to a switch. For example, moving the operating element in a first direction shifts the operating system into the retraction mode, while moving the operating element in a second direction shifts the operating system into the extension mode. In one embodiment, the first and second directions may be transverse to a longitudinal axis of the architectural-structure covering. In one implementation, for example, rearward or downward motion of the operating element (e.g., movement towards the architectural-structure covering, movement towards the architectural structure and away from an operator positioned in front of the covering), shifts the operating system into the retraction mode, while a forward motion of the operating element toward the operator positioned in front of the covering, shifts the operating system into the extension mode.

Once in the retraction mode, the operating element may be manipulated by the operator to retract or lift the covering of the architectural-structure covering. For example, a wand or flexible cord may be coupled to the operating element and a series of generally vertical reciprocating strokes (e.g., up and down strokes of the operating element) may retract or lift the covering. A brake element or mechanism may inhibit or prevent the covering of the architectural-structure covering from extending or lowering across the architectural structure during retraction. Thereafter, to shift the operating system into the extension mode, the operator may move the operating element in a second direction, for example, a forward direction or motion (e.g., towards the operator positioned in front of the covering).

Once in the extension mode, the covering may extend without further action by the operator. That is, in one implementation, once the operating system is shifted into the extension mode, the covering of the architectural-structure covering may lower automatically under the influence of gravity. As such, the movement (e.g., forward movement) of the operating element may shift the operating system into the extension mode, lowering the covering automatically via gravity and thus allowing the operator to walk away from the architectural-structure covering while the covering extends or lowers. If the operator desires to stop extension of the covering so that the covering is only partially extended, the operator may move the operating element in the first direction, for example, in a rearward or downward direction, away from the operator to shift the operating system into the retraction mode so that the brake element or mechanism may inhibit or prevent the covering of the architectural-structure covering from extending or lowering across the architectural structure.

BRIEF DESCRIPTION OF THE DRAWINGS

FIG. 3B is a second, exploded, perspective view of the operating system shown in

FIG. 2A;

FIG. 6 illustrates the operating element passing thru the shift arm with the shift arm being illustrated in a retraction mode;

DETAILED DESCRIPTION

Figure 1A:
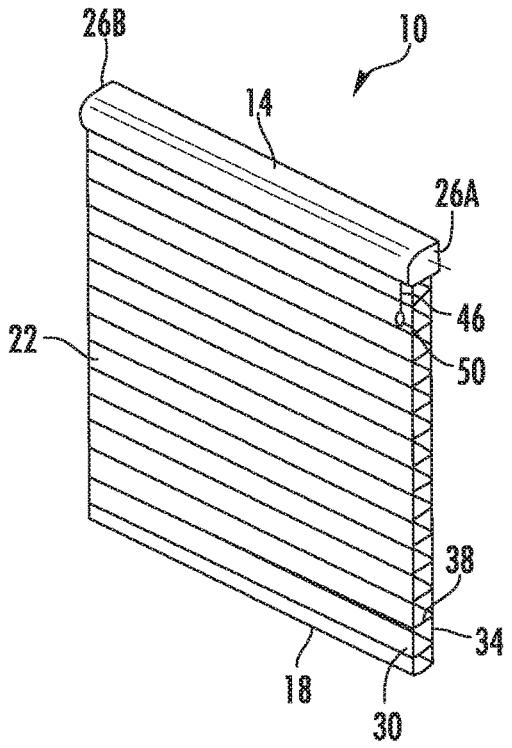
FIGS. 1A-1F are perspective views of a mechanically-operated architectural-structure covering with a covering illustrated in various positions.

Embodiments of an example, illustrative operating system for architectural-structure coverings in accordance with various separate and independent principles of the present disclosure will now be described more fully hereinafter with reference to the accompanying drawings, in which embodiments of the present disclosure are presented. The operating system of the present disclosure may, however, be embodied in many different forms and should not be construed as being limited to the embodiments set forth herein. Rather, these embodiments are provided so that this disclosure will convey certain aspects of the operating system to those skilled in the art. In the drawings, like numbers refer to like elements throughout unless otherwise noted.

The operating system may be a fully contained module and may support an end of an associated rotatable member. The operating system generally includes a retraction mode and an extension mode. When in the retraction mode, the operating system is operable to raise or retract a covering of the architectural-structure covering. When in the extension mode, the operating system is operable to lower or extend the covering of the architectural-structure covering.

As will be described in greater detail below, the operating system of the present disclosure may utilize an operating element, such as a cord, a ball chain, etc. The operating element may include a connector attached to a free end thereof for coupling to, for example, a wand or flexible cord. In use, the operating element may be used to switch, move, or transition (used interchangeable herein without the intent to limit) the operating system between the retraction mode and the extension mode and, once in the retraction mode, to retract or lift the covering of the architectural-structure covering. To transition between modes, an operator may move the operating element in a preset direction, such as, in the manner of a switch. For example, moving the operating element in a first direction shifts the operating system into the retraction mode, while moving the operating element in a second direction shifts the operating system into the extension mode. In one embodiment, the first and second directions may be transverse to a longitudinal axis of the architectural-structure covering. In one implementation, rearward or downward motion of the operating element (e.g., movement towards the architectural-structure covering, movement towards the architectural structure and away from an operator positioned in front of the covering) (collectively referred to herein as a rearward motion of the operating element), shifts the operating system into the retraction mode, while a forward motion of the operating element toward the operator positioned in front of the covering, shifts the operating system into the extension mode. One of ordinary skill in the art will appreciate that these directions may be reversed and that a forward motion of the operating element towards the operator may shift the operating system into the retraction mode, while a rearward motion of the operating element away from the operator may shift the operating system into the extension mode.

Once in the retraction mode, in one implementation, a single retractable operating element may be manipulated by an operator with one or more generally vertical reciprocating strokes (e.g., up and down strokes of the operating element) to retract or lift the covering of the architectural-structure covering. A brake element or mechanism may inhibit or prevent the covering of the architectural-structure covering from extending or lowering across the architectural structure during retraction. To shift the operating system into the extension mode, an operator may move the operating element in a second direction, for example, a forward direction or motion (e.g., towards the operator positioned in front of the covering).

Once in the extension mode, the covering may extend without further action by the operator. In one implementation, once the operating system is shifted into the extension mode, the covering of the architectural-structure covering may lower automatically under the influence of gravity. The operating system may include a speed governing device to control or regulate the extension or lowering speed of the covering.

In one embodiment, a method for raising and lowering a covering portion of an architectural-structure covering is disclosed. The method including moving an operating element associated with an operating system of the architectural-structure covering in a first direction for placing the operating system into a retraction mode for raising the covering portion from a fully or partially extended position, moving the operating element for raising the covering portion from the fully or partially extended position, and moving the operating element in a second direction to transition the operating system into an extension mode for lowering the covering portion from a fully or partially retracted position. In one embodiment, the first and second directions are transverse to a longitudinal axis of the architectural-structure covering. In one embodiment, the first direction is one of a forward or rearward direction, and the second direction is the other one of a forward or rearward direction.

The covering portion may be extended automatically via gravity when in the extension mode. The covering portion may be raised via a plurality of reciprocating strokes of the operating element when in the retraction mode. The method may further include engaging a brake element to prevent extending the covering portion in-between the reciprocating strokes.

In one embodiment, moving the operating element in the first and second directions selectively switches between the retraction mode and the extension mode by manipulating a position of a shift arm associated with the operating system. Moving the operating element in the first and second directions selectively moves the position of the shift arm into and out of engagement with a portion of a transmission of the operating system.

In one embodiment, an architectural-structure covering is disclosed. The architectural-structure covering includes a rotatable member rotatable about a longitudinal axis in an extension direction and a retraction direction, a covering portion, and an operating system operably associated with the rotatable member. The operating system includes a transmission to selectively transmit an input torque to the rotatable member, a shift arm for selectively engaging the transmission for transitioning the operating system between a retraction mode and an extension mode, and an operating element operable to supply the input torque, and for selectively transitioning the shift arm between the retraction mode and the extension mode. The shift arm is movable in one of a first direction and a second direction for transitioning the operating system between the retraction mode and the extension mode. In one embodiment, the first and second directions are transverse to a longitudinal axis of the architectural-structure covering.

In one embodiment, the first direction is one of a forward or rearward direction with respect to an operator positioned in front of the covering portion, the second direction is the other one of the forward or rearward direction.

In one embodiment, in the retraction mode, the shift arm engages the transmission to prevent rotation of the rotatable member in the extension direction. In the extension mode, the shift arm is disengaged from the transmission to permit rotation of the rotatable member in the extension direction.

In one embodiment, the architectural-structure covering may also include a base, the shift arm being pivotably coupled to the base. The shift arm includes a projection for engaging the transmission when the shift arm is in the retraction mode. The transmission may include a ring gear including one or more projections, the projection formed on the shift arm intermeshing with the one or more projections formed on the ring gear in the retraction mode to prevent rotation of the ring gear. In the extension mode, the projection formed on the shift arm is spaced from the one or more projections formed on the ring gear to permit rotation of the ring gear. The base may also include a lower surface and an opening passing through the lower surface, the lower surface including a first surface, a second surface, and a junction connecting the first and second surfaces. The junction may be adapted and configured to resist movement of the operating element.

Referring to FIGS. 1A-1F, an example embodiment of an architectural-structure covering 10 is illustrated. The architectural-structure covering 10 may include a covering 22 movable between an extended position and a retracted position.

It should be understood that the covering 22 may be any suitable covering now known or hereafter developed and that the operating system of the present disclosure may be used in conjunction with any covering 22 now known or hereafter developed. For example, the covering 22 may be constructed of substantially any type of material. For example, the covering 22 may be constructed from natural and/or synthetic materials, including fabrics, polymers, and/or other suitable materials. Fabric materials may include woven, non-woven, knits, or other suitable fabric types. The covering 22 may have any suitable level of light transmissivity. For example, the covering 22 may be constructed of transparent, translucent, and/or opaque materials to provide a desired ambience or decor in an associated room.

As illustrated, the covering 22 may include vertically suspended front 30 and rear 34 sheets of flexible material, such as sheer fabric, and a plurality of horizontally-extending, vertically-spaced flexible vanes 38. The vanes 38 may extend between the front and rear sheets 30, 34.

As illustrated, the architectural-structure covering 10 may also include a bottom rail 18 coupled to the lower edge of the covering 22. The bottom rail 18 may extend horizontally along a lower edge of the covering 22 and may function as a ballast to maintain the covering 22 in a taut condition and to aid in a gravity-assisted extension of the covering 22.

The architectural-structure covering 10 may also include a head rail 14 having two opposing end caps 26A, 26B, which may enclose the ends of the head rail 14 to provide a finished appearance and provide structural support for the covering components.

As will be generally understood by one of ordinary skill in the art, the covering 22 may be operably associated with a rotatable member (e.g., a roller) located in the head rail 14 so that rotational movement of the rotatable member about a longitudinally-extending axis moves the covering 22 between extended and retracted positions. For example, rotation of the rotatable member in a first direction may retract the covering 22 while rotation of the rotatable member in a second, opposite direction may extend the covering 22. The covering 22 may be coupled to and wrappable about the rotatable member, so that rotation of the rotatable member causes the covering 22 to wrap around or unwrap from the rotatable member depending upon the direction of rotation. In one implementation, the covering 22 is wrapped about or unwrapped from a rear side of the rotatable member, with the rear side of the rotatable member positioned intermediate the front side of the rotatable member and a street side of an associated architectural structure. Alternatively, the covering 22 may be stackable or gatherable adjacent to or beneath the rotatable member. For example, the architectural-structure covering 10 may include a lift element, such as a lift cord, wrappable about a spool and operatively coupled to the covering portion 22. As the rotatable member is rotated, the lift elements are wrapped about or unwrapped from the spool to effect extension or retraction of the covering 22.

Still referring to FIGS. 1A-1F, an example embodiment of a roller style, architectural-structure covering 10 is shown with the covering 22 illustrated in various positions. FIG. 1A depicts the covering 22 in a fully extended position in which rotation of the rotatable member moves the front and rear sheets 30, 34 vertically (relative to each other) to shift the vane 38 material between open and closed positions. In the open or expanded position, the front and rear sheets 30, 34 are horizontally spaced with the vanes 38 extending substantially horizontally therebetween. FIGS. 1B-1F depict the covering 22 in partially extended or retracted positions in which the covering 22 is in the closed position. When in the closed or collapsed position, the front and rear sheets 30, 34 are relatively close together and the vanes 38 extend generally vertically in an approximately coplanar, contiguous relationship with the front and rear sheets 30, 34. It is envisioned that any other covering portion 22 may be used.

With continued reference to FIGS. 1A-1F, the architectural-structure covering 10 includes an operating system that may allow an operator of the architectural-structure covering 10 to lift or lower the bottom rail 18 between the fully retracted position and the fully extended position. The operating system may include a drive mechanism configured to provide an input torque to the operating system. The drive mechanism may be in the form of an operating element 46. The operating element 46 may be a cord, a ball chain, or other suitable device. The operating element 46 may include a connector 50 at a free end thereof for coupling to, for example, a wand or flexible pull cord.

The operating system may be operated mechanically. For example, the architectural-structure covering 10 may be operated mechanically via the operating element 46.

Figure 1B:
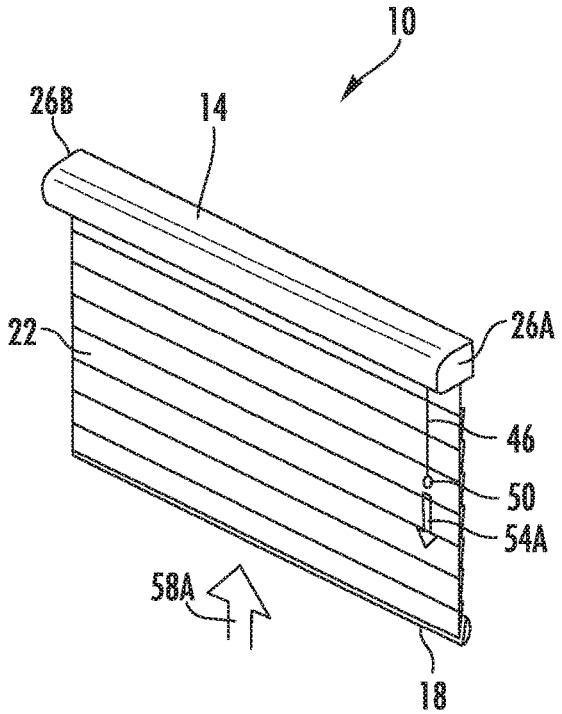

To retract or lift the covering 22 from the fully extended position illustrated in FIG. 1A, an operator may move the operating element 46 with one or more generally vertical reciprocating or repeating strokes (e.g., up and down strokes of the operating element, collectively referred to herein as reciprocating strokes). As shown in FIG. 1B, upon downward movement of the operating element 46 (represented by the arrow 54A), the covering 22 is retracted, raised, or lifted (represented by the arrow 58A) from the fully extended position of FIG. 1A. Upon reaching the bottom of the downward stroke of the operating element 46, an operator may release or resistively raise the operating element 46 and the operating system automatically retracts or reels in the operating element 46 (represented by the arrow 54B in FIG. 1C) for repeated actuation.

Figure 1C:
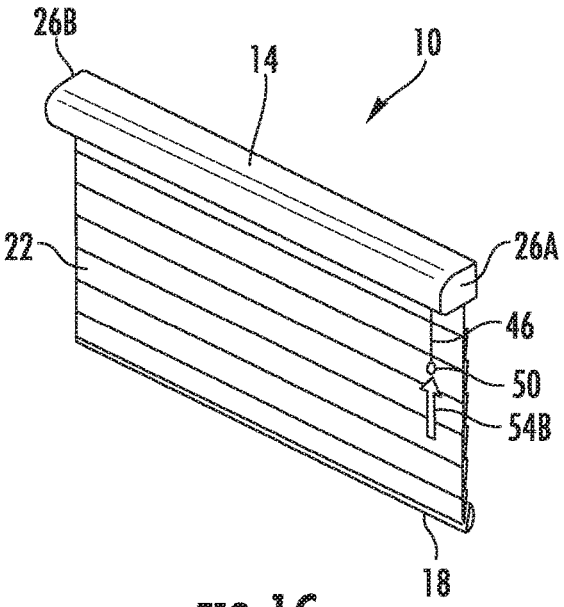
Figure 1D:
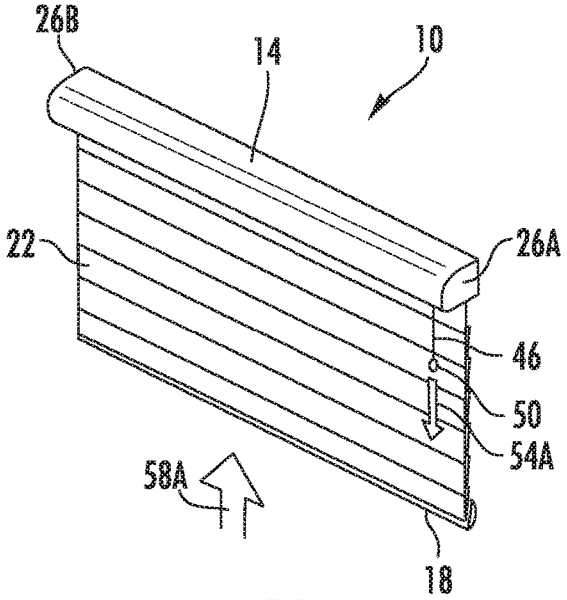
Figure 1E:
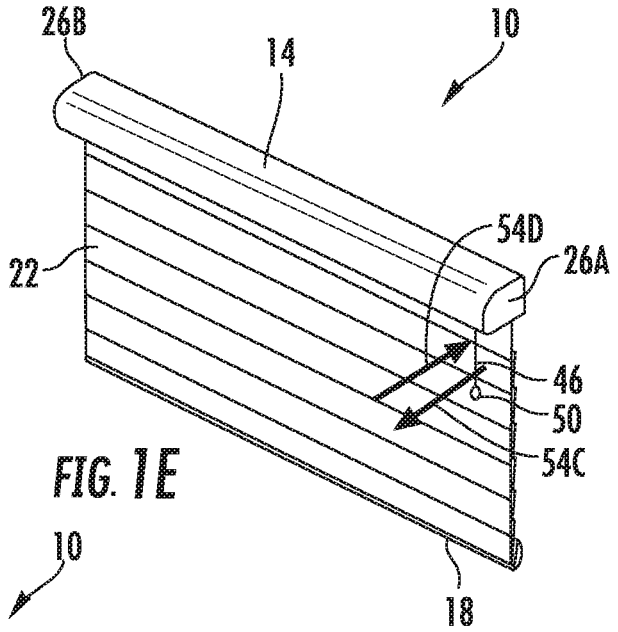
Figure 1F:
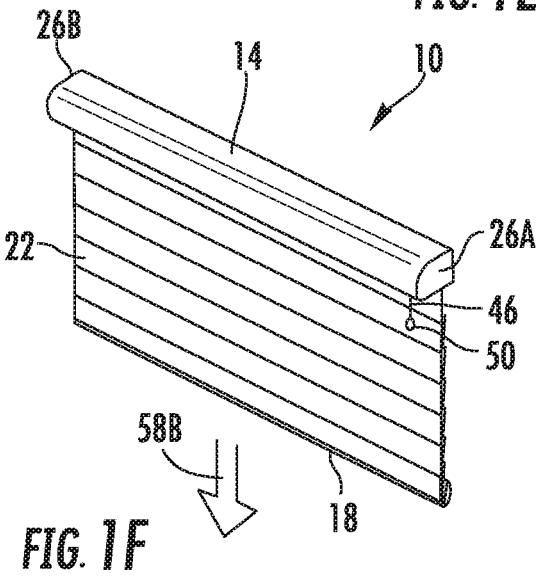
Figure 2A:
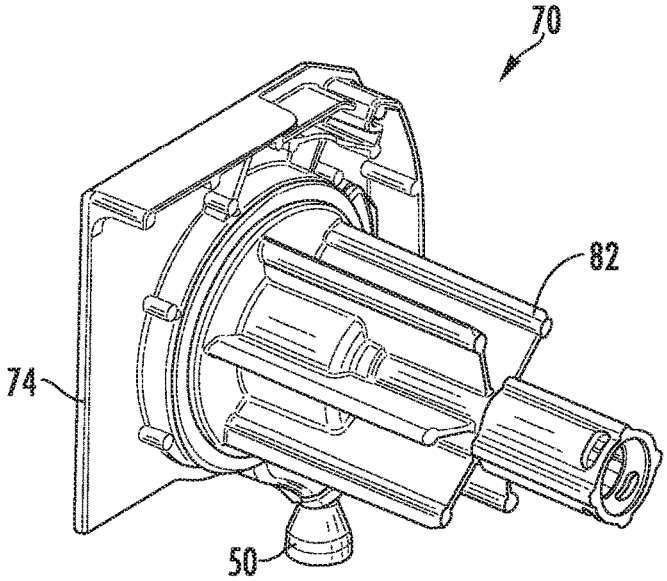
FIG. 2A is a perspective view of an example embodiment of an operating system.
Figure 2B:
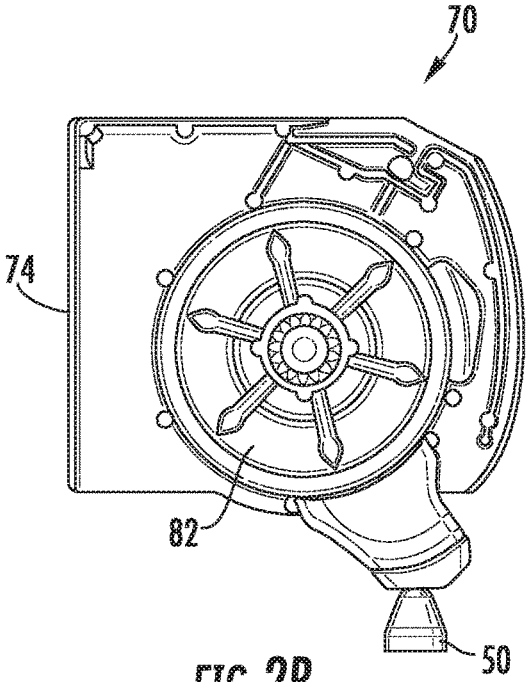
FIG. 2B is an end view of the operating system shown in FIG. 2A.
Figure 2C:
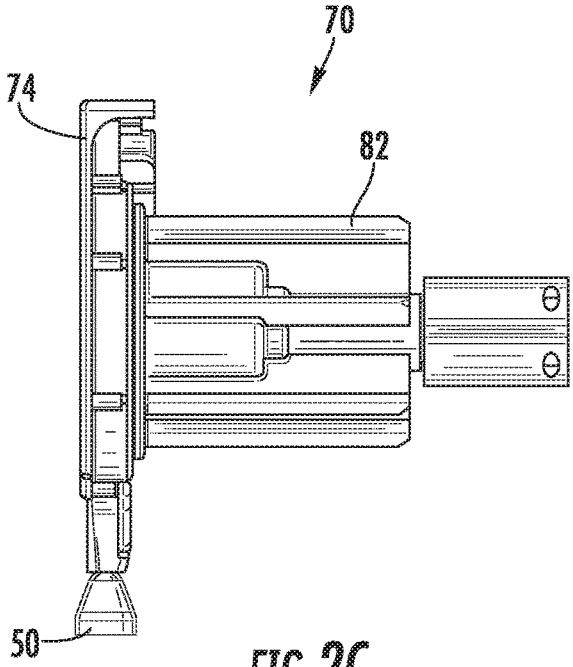
FIG. 2C is a side view of the operating system shown in FIG. 2A.

As shown in FIG. 1C, as the operating element 46 is retracted, the operating system maintains or holds the covering 22 in its extended state. Once the operating element 46 has retracted a distance above the bottom of the stroke, an operator may move the operating element 46 in a second stroke to further retract the covering 22, as depicted in FIG. 1D. This reciprocating process is repeated until the covering 22 is retracted to a desired position. The reciprocating stroke of the operating element 46 may vary in different implementations of the operating system. In one implementation, the operating element 46 is about 48 inches in length. The ratio of the retraction of the covering 22 to the stroke of the operating element 46 also may vary depending on the specific implementation of the operating system. In one implementation, the ratio of covering retraction to operating element extension is approximately 0.4.

To extend or lower the covering 22 from a fully or partially retracted or lifted position, an operator standing in front of the covering 22 may move the operating element 46 in a second direction. In one embodiment, the second direction may be transverse to a longitudinal axis of the architectural-structure covering. In one implementation, to extend or lower the covering 22 from a fully or partially retracted or lifted position, the operator standing in front of the covering 22 may move the operating element 46 in a forward direction, toward the operator, as indicated by the arrow 54C in FIG. 1E. The forward movement of the operating element 46 may shift the operating system into an extension mode in which the covering 22 may extend or lower automatically via gravity. Thus, in one implementation, after transitioning the operating system into the extension mode, the operator can release the operating element 46 and walk away from the architectural-structure covering 10 while the covering 22 extends or lowers without operator intervention, as indicated by arrow 58B in FIG. 1F. After the covering 22 is extended to a desired position, the operator standing in front of the covering 22 can inhibit further extension, as well as retract or raise the covering 22, if desired, by moving the operating element 46 in a first direction. In one embodiment, the first direction may be transverse to a longitudinal axis of the architectural-structure covering. In one implementation, the operator standing in front of the covering 22 can inhibit further extension, as well as retract or raise the covering 22, if desired, by moving the operating element 46 in a rearward direction, away from the operator, as indicated by the arrow 54D in FIG. 1E. Moving the operating element 46 in a rearward direction, away from the operator, transitions the operating system into the retraction mode, where a brake element or mechanism prevents any further extension or lowering of the covering 22. In addition, in the retraction mode, the covering 22 may be further retracted in response to the reciprocating process as described above and shown in FIGS. 1A-1D.

Referring to FIGS. 2A-3B, an example embodiment of an operating system 70 is illustrated. The operating system 70 may be assembled as a single, modular unit. In one embodiment, the operating system 70 may support an associated end of the rotatable member. Additionally, the operating system 70 may be coupled to one end of the head rail 14. The operating system 70 may be pre-assembled and thus simplify assembly of the architectural-structure covering 10. The operating system 70 may be referred to as an operating module or unit.

Figure 3A:
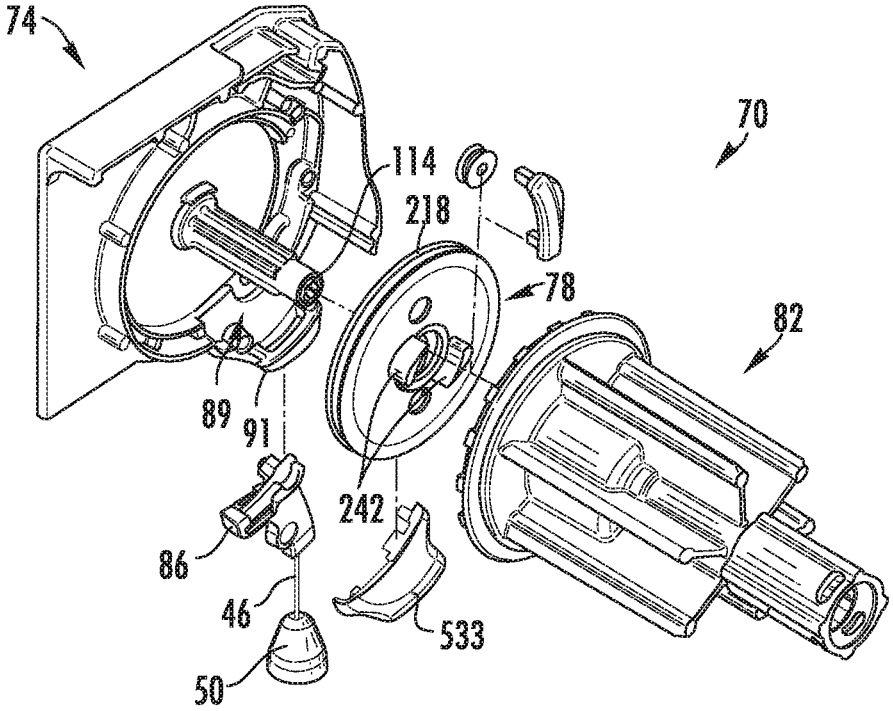
FIG. 3A is a first, exploded, perspective view of the operating system shown in FIG. 2A.
Figure 3B:
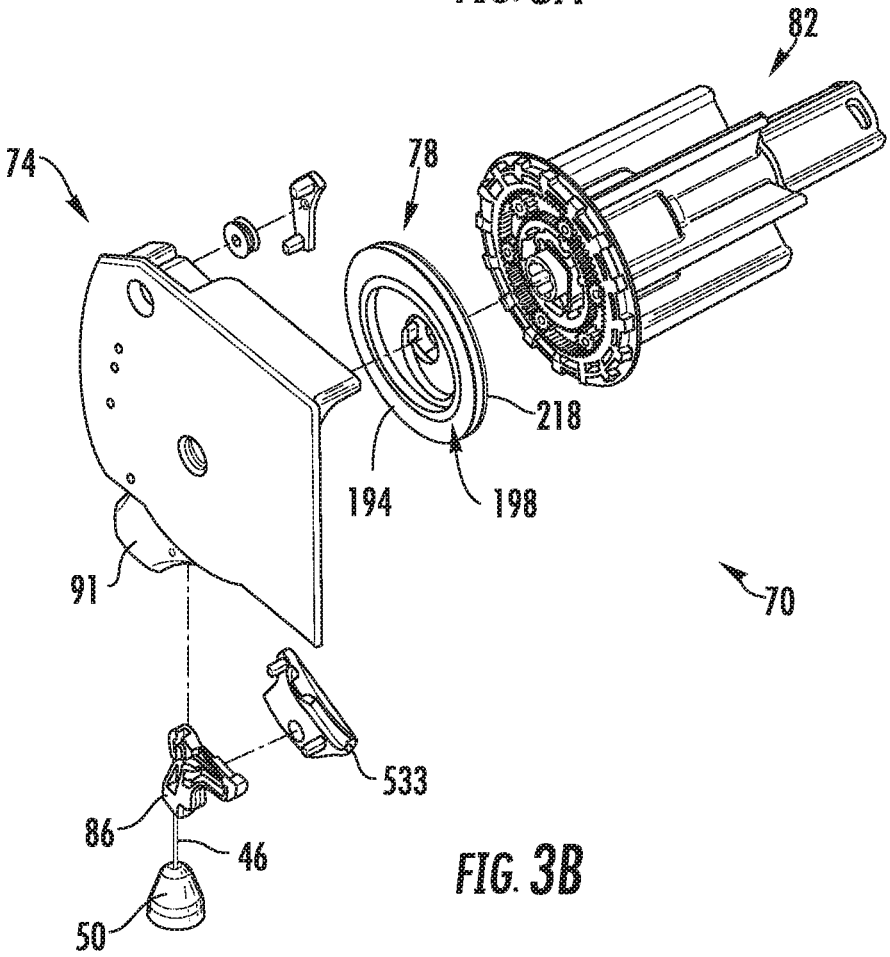

Referring to FIGS. 3A and 3B, the operating system 70 is shown in an exploded, sub-assembly view. The operating system 70 may include a base 74, a drive mechanism 78, a transmission 82, and a shift arm 86. The base 74, the drive mechanism 78, and the transmission 82 may be aligned along a common axis, which may be co-axial with a central axis of the rotatable member about which the covering 22 is wrapped. The shift arm 86 may be laterally offset from the common axis and may be movably disposed within a pocket 89 formed in a housing extension portion 91 formed within the base 74 near the periphery of the transmission 82. The shift arm 86 may shift the operating system 70 between the retraction and extension modes. In one implementation, the shift arm 86 selectively interacts with the transmission 82 to transition the operating system 70 between the retraction and extension modes as further described below. While the housing extension portion 91 is illustrated as being integrally formed with the base 74, it is envisioned that the housing extension portion 91 may be separately formed and coupled thereto.

The drive mechanism 78 may include a spool assembly having a spool 194 biased by a spool spring 198.

Figure 4A:
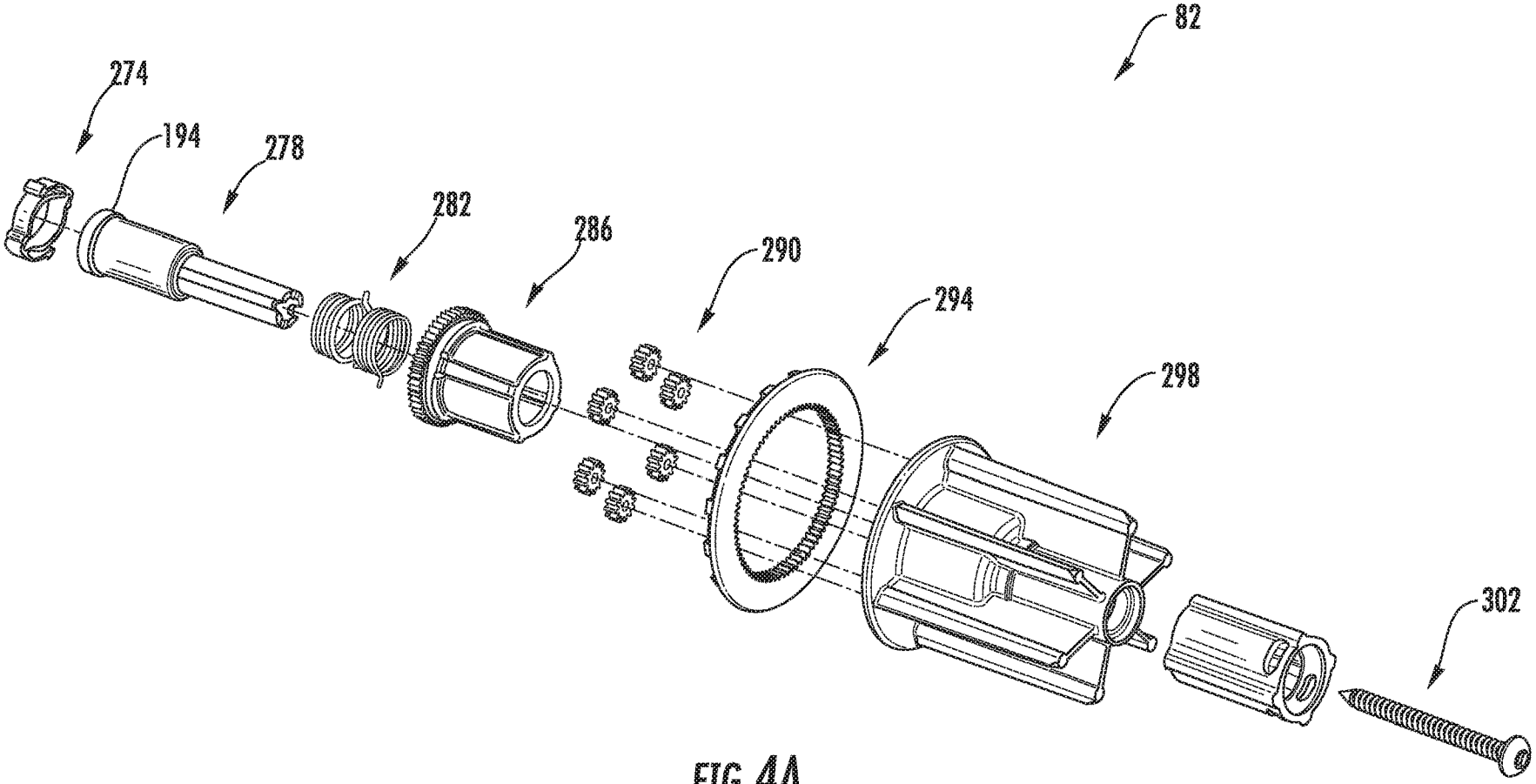
FIG. 4A is a first, exploded, perspective view of an example embodiment of a transmission that may be used with the operating system shown in FIG. 2A.
Figure 4B:
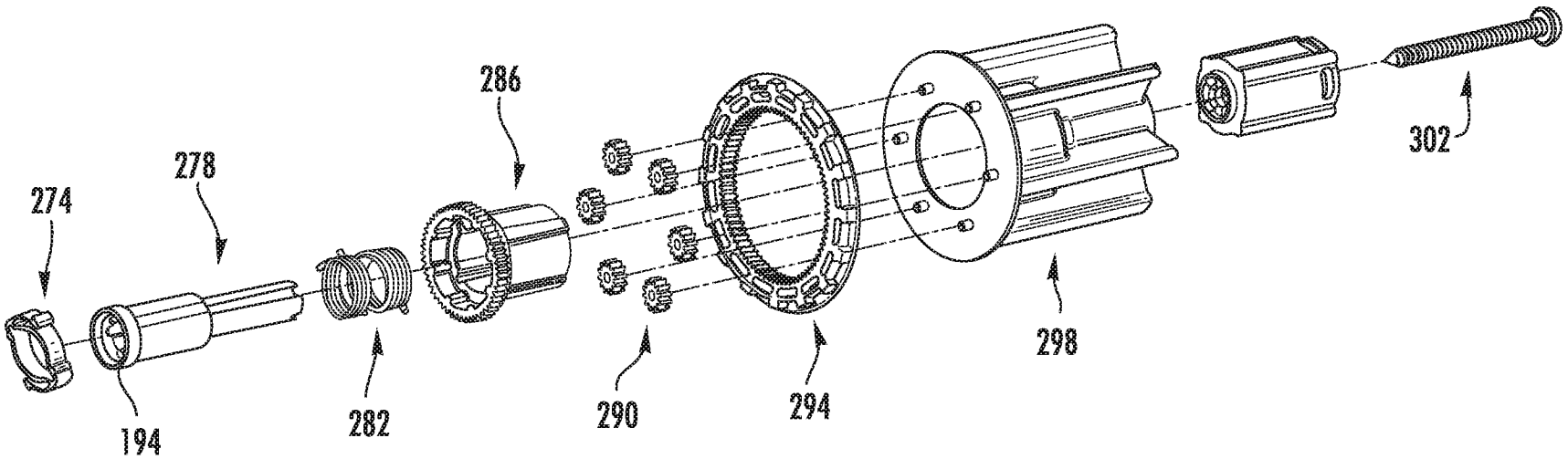
FIG. 4B is a second, exploded, perspective view of the transmission shown in FIG. 4A.
Figure 5A:
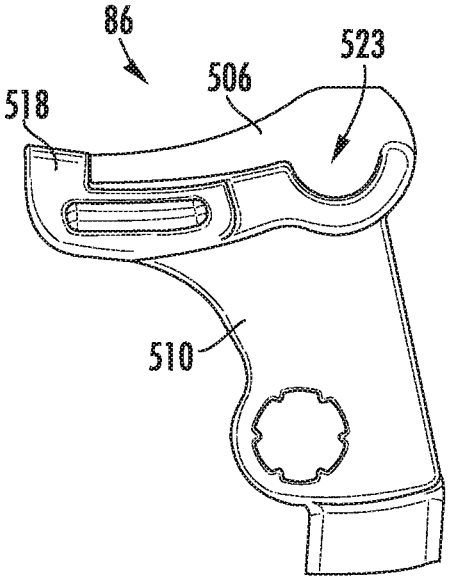
FIG. 5A is a first, distal side view of an example embodiment of a shift arm that may be used with the operating system shown in FIG. 2A.
Figure 5B:
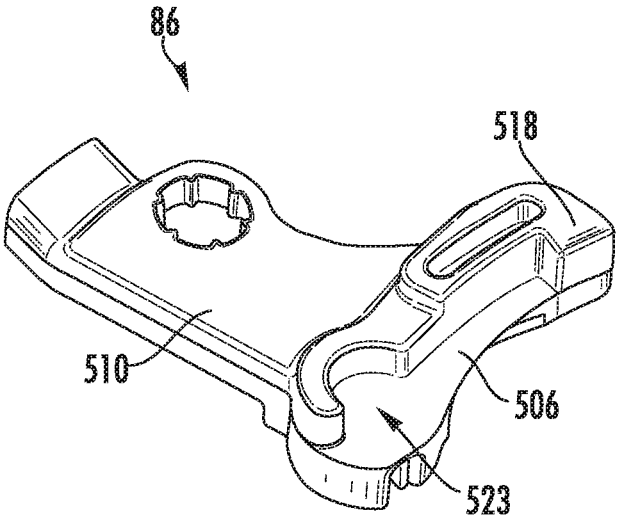
FIG. 5B is a first, distal perspective view of the shift arm shown in FIG. 5A.
Figure 5C:
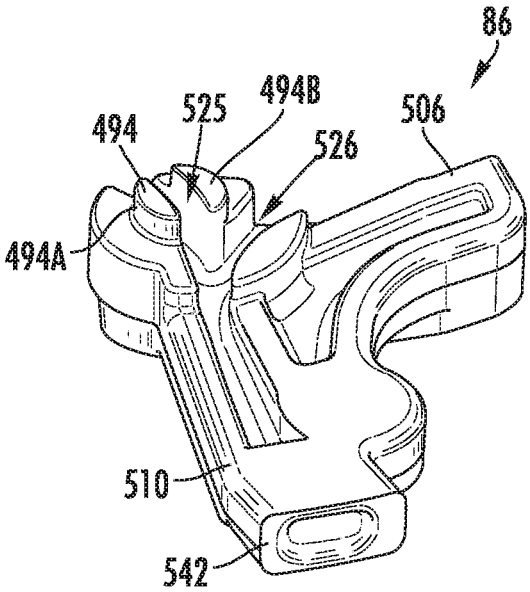
FIG. 5C is a second, proximal perspective view of the shift arm shown in FIG. 5A.
Figure 5D:
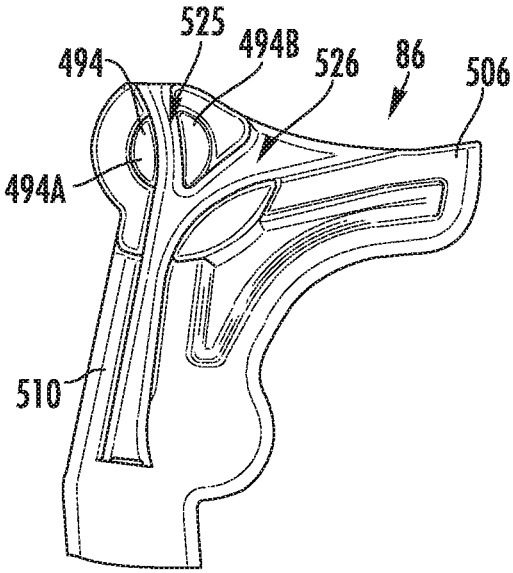
FIG. 5D is a second, proximal side view of the shift arm shown in FIG. 5A.

Referring to FIGS. 4A and 4B, an example embodiment of the transmission 82 of the operating system 70 is illustrated. The transmission 82 includes a clutch element 274, an axle 278, at least one wrap spring 282, a sun gear 286, a plurality of planet gears 290, an annulus or ring gear 294, a planet carrier 298, and a fastener 302. When assembled, the components of the transmission 82 may be coaxially aligned with a post 114 extending from the base 74 (FIG. 3A). During retraction of the covering 22, the transmission 82 may receive an input torque from the drive mechanism 78 and provide an output torque to the rotatable member. The transmission 82 may provide a gear reduction, such as by the example planetary gear system, to reduce the amount of input torque required to retract the covering 22. During extension of the covering 22, the transmission 82 may be disengaged from the other components of the operating system 70 so that the rotatable member can rotate in an extension or lowering direction via gravity.

Additional information on the structure and operation of the base 74, the drive mechanism 78, and the transmission 82, and the components thereof, can be found in U.S. patent application Ser. No. 14/766,043 entitled "Operating System for A Covering for An Architectural Opening".

Referring now to FIGS. 3A, 3B, and 5A-5D, an example embodiment of a shift arm 86 of the operating system 70 is illustrated. The shift arm 86 may selectively engage the transmission 82 to transition the operating system 70 between the retraction and extension modes. Although the following discussion describes a shift arm 86 shifted mechanically by the operating element 46, the shift arm 86 may be actuated by other means, for example, electrically.

In one implementation, an operator moves the shift arm 86 between modes by manipulating the operating element 46 in predefined directions, such as, in a manner akin to a switch. For example, moving the operating element in a first direction shifts the operating system into the retraction mode, while moving the operating element in a second direction shifts the operating system into the extension mode. In one embodiment, the first and second directions may be transverse to a longitudinal axis of the architectural-structure covering. For instance, the operator may move the operating element 46 in a forward direction (e.g., towards the operator, in the direction indicated by the arrow 54C in FIG. 1E) to move the shift arm 86 into a shade extension mode, thereby permitting the covering 22 to automatically extend or lower, such as by gravity. Once in the shade extension mode, the operator may move the shift arm 86 into a shade retraction mode (which stops the extension) by moving the operating element 46 in a rearward direction (e.g., away from the operator, in the direction indicated by the arrow 54D in FIG. 1E).

As will be described in greater detail below, the shift arm 86 may be coupled to the base 74 of the operating system 70 adjacent the transmission 82. More specifically, the shift arm 86 may be movably (e.g., pivotably) coupled to the base 74 and positioned within a pocket 89 formed in a housing extension portion 91 extending from the base 74. In one implementation, the shift arm 86 may be constrained within a preset pivotable range, as will be described in greater detail below. In use, at one end of the pivot range, the shift arm 86 may contact the transmission 82 to substantially prevent rotation of the rotatable member in a shade extending direction, which may be referred to as the shade retraction mode for the sake of simplicity without the intent to limit. At the other end of the pivot range, the shift arm 86 may be disengaged from the transmission 82 to permit rotation of the rotatable member in the shade extension direction, which may be referred to as the shade extension mode for the sake of simplicity without the intent to limit.

Figure 6:
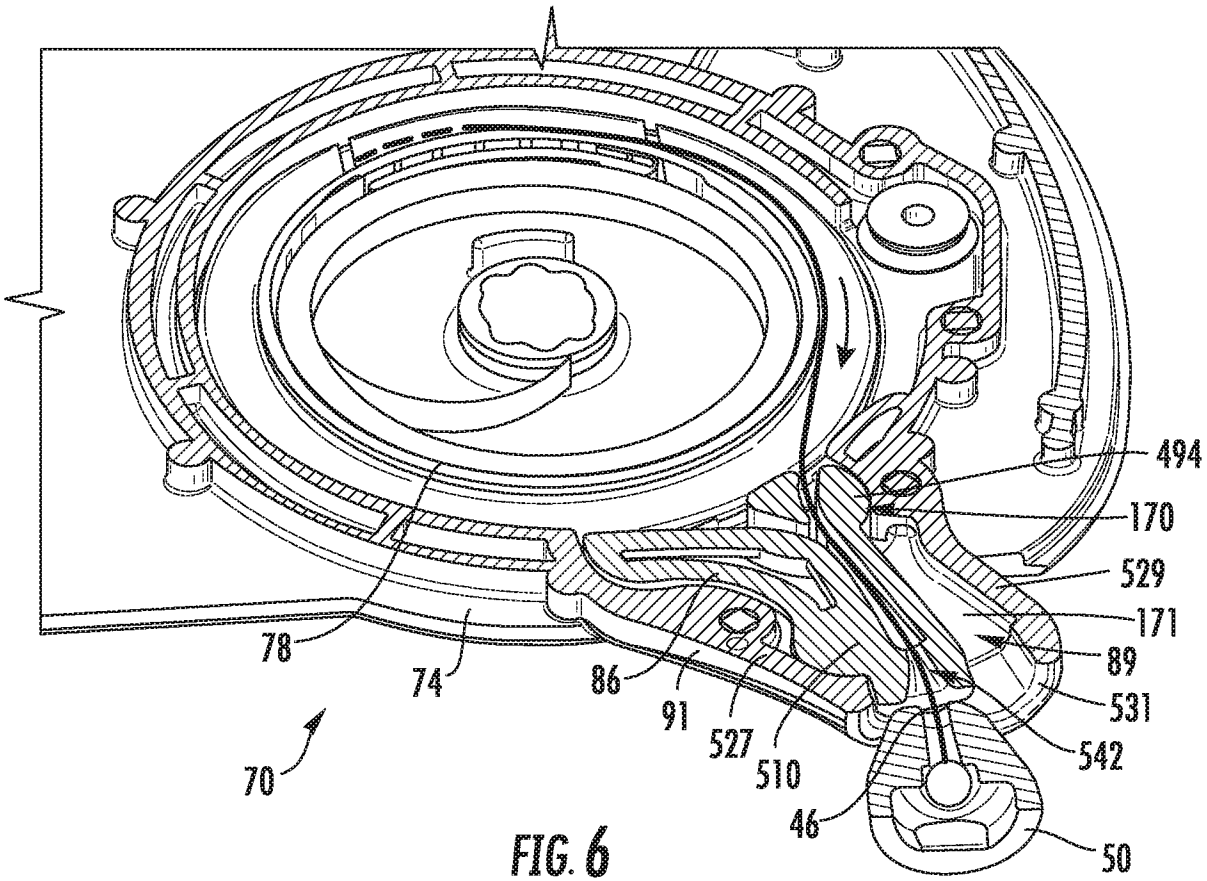
FIG. 6 is a perspective view illustrating some components of the operating system shown in FIG. 2A.

Referring to FIGS. 5A-5D, an example embodiment of the shift arm 86 is illustrated. The illustrated shift arm 86 includes a post 494 (FIGS. 5C and 5D) configured to be rotatably seated within an aperture 170 in a distal surface 171 of the housing extension portion 91 of the base 74 as best shown in FIG. 6. The post 494 may be received within the aperture 170 by any means now known or hereafter developed. For example, the post 494 may include catch or snap features to axially couple the post 494 within the aperture 170 while permitting rotation of the shift arm 86 relative to the base 74. The pivot axis of the shift arm 86 may be generally parallel to a central longitudinal axis of the transmission 82. When assembled, the post 494 may extend in a proximal direction towards the base 74.

Figure 9A:
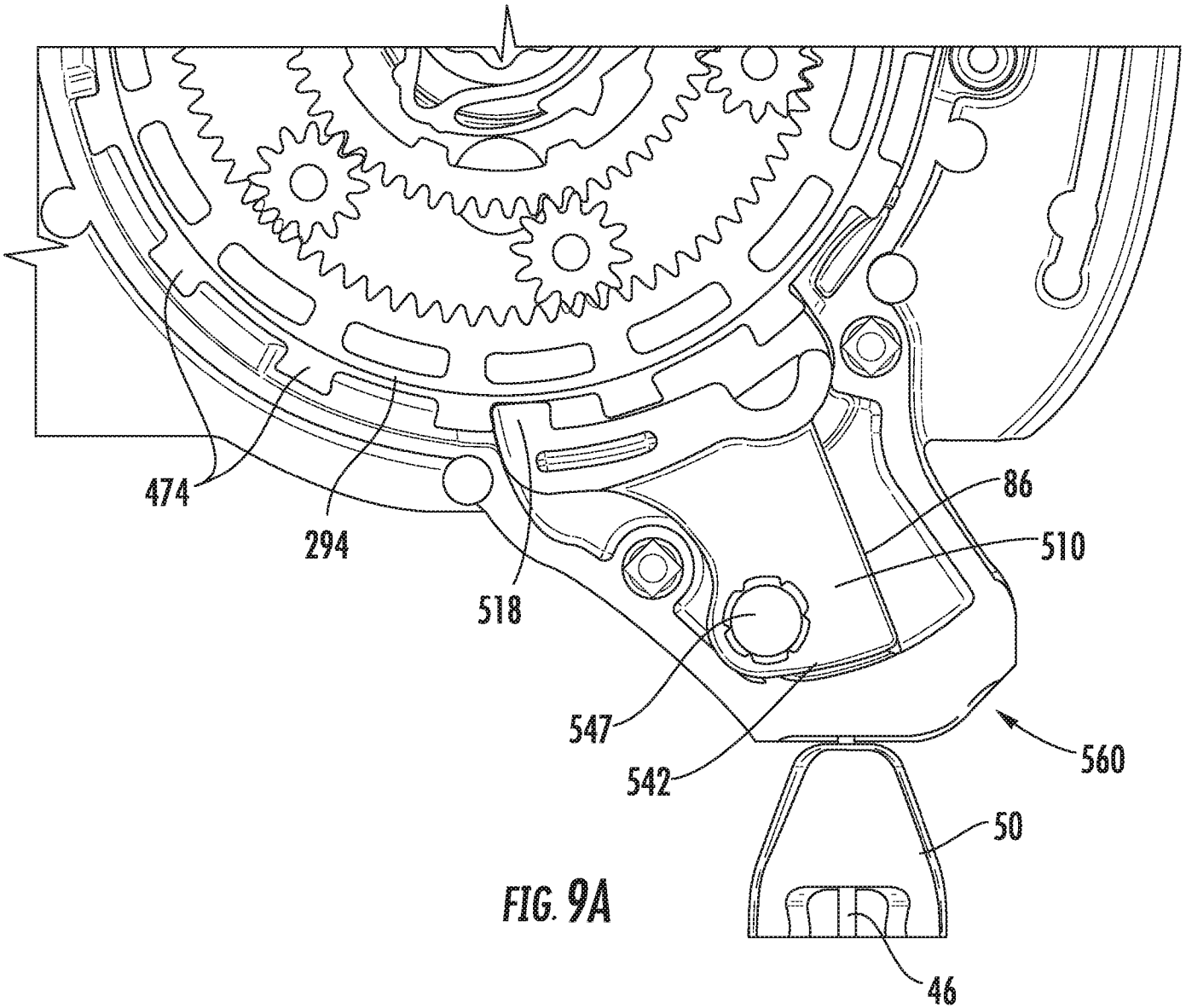
FIG. 9A is a partial, detailed view of the operating system shown in FIG. 2A illustrated in a retraction mode.
Figure 9B:
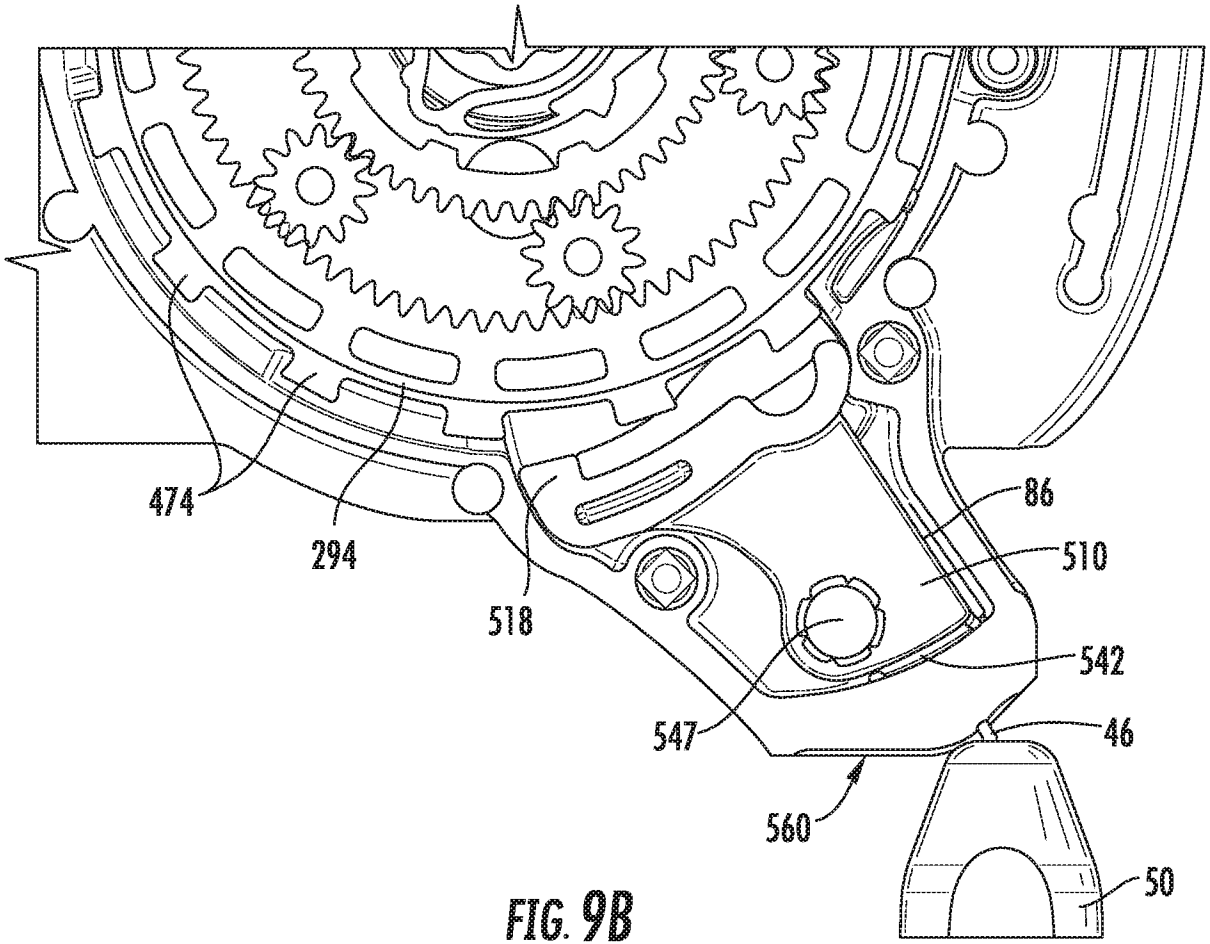
FIG. 9B is a partial, detailed view of the operating system shown in FIG. 2A illustrated in an extension mode.

The shift arm 86 also may include one or more projections 518 (FIGS. 5A and 5B) for contacting and engaging to the transmission 82 when the shift arm 86 is in the shade retraction mode. That is, when the shift arm 86 is in the shade retraction mode, as shown in FIG. 9A, the projection 518 of the shift arm 86 may matingly engage (e.g., intermesh) with one or more projections 474 formed on the ring gear 294 to substantially prevent rotation of the ring gear 294. When the shift arm 86 is in the shade extension mode, as shown in FIG. 9B, the shift arm 86 may be pivoted away from the transmission 82 so that the projection 518 formed on the shift arm 86 is spatially separated from the projections 474 formed on the ring gear 294 to permit rotation of the ring gear 294.

Referring to FIGS. 5A-5D, the shift arm 86 may include a coupling arm 506 and a lever arm 510. As illustrated, the coupling arm 506 and the lever arm 510 may be formed so that they intersect with one another to form a generally right angle so that the in-out movement (movement of the operating element 46 towards and away from the operator) moves the coupling arm 506 into and out of engagement with the ring gear 294 as described above. As such, the shift arm 86 may be generally L-shaped, although other shapes are envisioned. The projection 518 and the post 494 may be spaced apart from each other along a length of the coupling arm 506, with the projection 518 extending from a distal side of the coupling arm 506, and with the post 494 extending from a proximal side of the coupling arm 506. A pocket 523 may be formed in the distal side of the coupling arm 506 and may be coaxial with the post 494. The pocket 523 may be semi-circularly-shaped for receiving a pivot pin 543 extending from a proximal side of a cover 533, as will be described in greater detail below. It is envisioned that the pocket 523 may have other shapes.

The shift arm 86 may further include a pathway or channel 525 formed in the proximal side thereof. The channel 525 may extend vertically through the post 494 thus subdividing the post 494 into first and second post members 494A, 494B. The channel 525 may further extend through the lever arm 510 and may terminate in an opening 542 (FIG. 5C) such as, for example, an eyelet at the free end of the lever arm 510. The channel 525 and the opening (e.g., eyelet) 542 may be configured to accommodate the passage of the operating element 46 through the shift arm 86, with the operating element 46 passing through, or nearly through, the axis of the post 494 as illustrated in the cross-sectional view of the operating system 70 shown in FIG. 6. Thus, when the operating element 46 is manipulated (e.g., moved in a first or second direction (e.g., forward or rearward) via the operating element 46) during use of the operating system 70, the operating element 46 may move about the axis of the post 494 (or an axis near the axis of the post 494) and may move the lever arm 510, thereby causing the shift arm 86 to move about the axis of the post 494 into and out of contact with the ring gear 294.

Referring to FIG. 6, and as previously mentioned, the housing extension portion 91 formed in the base 74 may include a pocket 89 sized and shaped to accommodate the shift arm 86 and to allow movement such as, for example pivotal movement, of the shift arm 86 about the axis of the post 494 while limiting the extent of such movement to a desired range (e.g., the preset pivot range described above). For example, the pocket 89 formed in the housing extension portion 91 may include a front wall 527 and a rear wall 529 that restrict movement of the lever arm 510 in the forward and rearward directions, respectively. The housing extension portion 91 may further include an opening 531 such as, for example, an eyelet adjacent to and aligned with the opening (e.g., eyelet) 542 of the shift arm 86 for allowing pass-through of the operating element 46.

Figure 7:
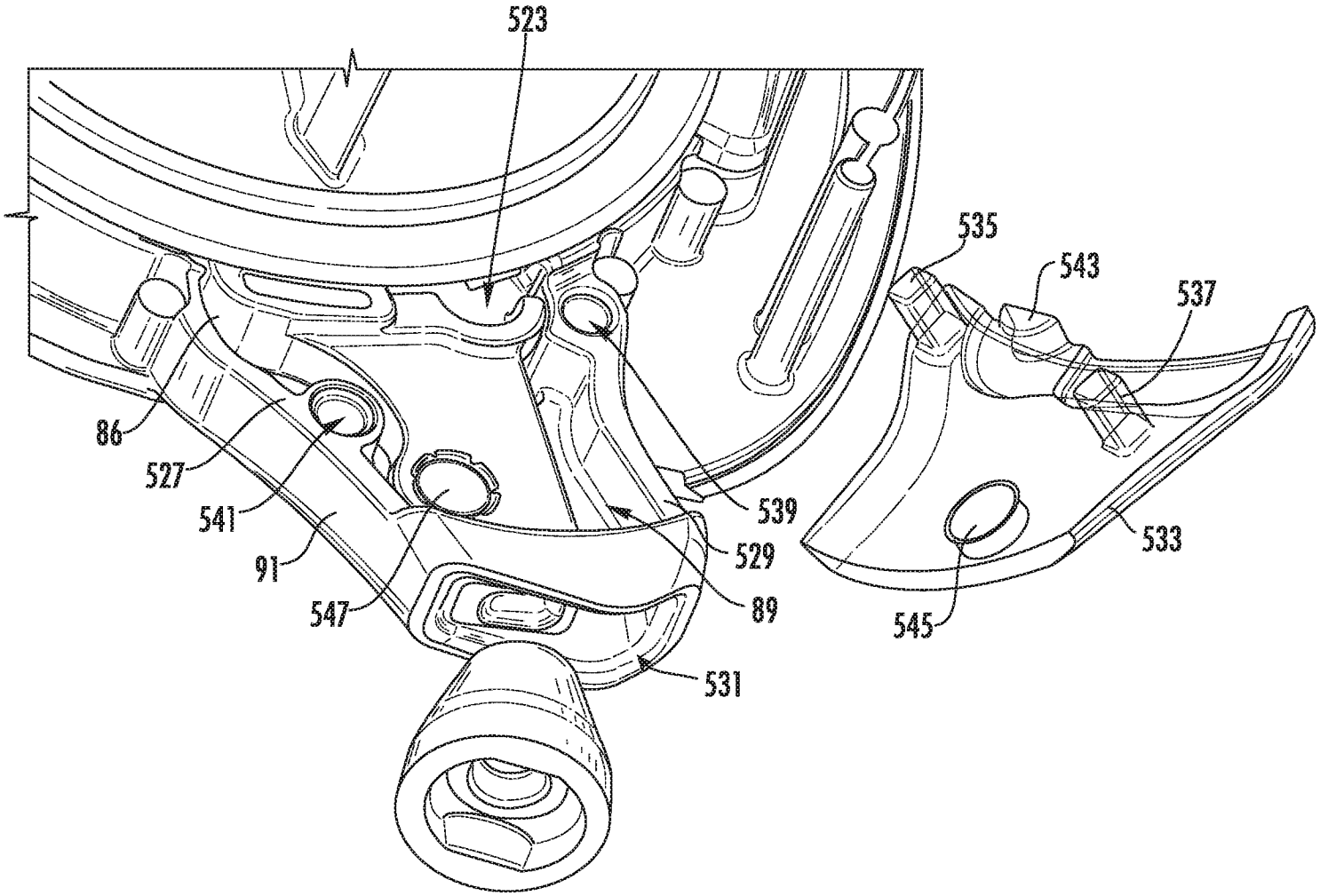
FIG. 7 is a partial, exploded, perspective view of an example embodiment of a removable cover disengaged from the base.

Referring to FIG. 7, the operating system 70 may further include a removable cover 533 adapted to enclose the pocket 89 and the shift arm 86 within the pocket 89. The cover 533 may include one or more bosses, illustrated as first and second bosses 535, 537 that extend from the proximal side of the cover 533. The bosses 535, 537 being adapted to matingly engage corresponding mounting apertures 539, 541 formed in the distal side of the housing extension portion 91 of the base 74, illustrated in the front and rear walls 527, 529 of the pocket 89. The bosses 535, 537 may be held within the mounting apertures 539, 541 via any method now known or hereafter developed including, for example, via a friction fit, snap fit, etc. to removably couple the cover 533 to the base 74. It will be appreciated that the number of bosses and mounting apertures may be varied, and that additional or alternative mounting structures or configurations may be implemented for removably coupling the cover 533 to the base 74 without departing from the present disclosure.

As previously mentioned, the cover 533 may further include a pivot pin 543 extending from the proximal side of the cover 533. In use, when the cover 533 is coupled to the base 74, the pivot pin 543 may extend into the pivot pocket 523 formed on the distal side of the shift arm 86 and may be disposed in a substantially coaxial relationship with the post 494 formed on and extending from the proximal side of the coupling arm 506. Thus, engagement between the post 494 (FIGS. 5C and 5D) and the pivot aperture 170 (FIG. 6) may provide the shift arm 86 with radial stability on the proximal side of the shift arm 86, and engagement between the pivot pin 543 (FIG. 7) and the pivot pocket 523 (FIGS. 5A, 5B and 7) may provide the shift arm 86 with radial stability on the distal side of the shift arm 86. As illustrated, the pivot pin 543 may include a semicircular shape, although other shapes are envisioned including, but not limited to, a circular shape.

The operating system 70 may include a detent to deter or prevent accidental or unintentional shifting between the retracted and extended configurations. The detent may be any now known or hereafter developed detent mechanism for preventing unwanted movement. For example, the cover 533 and the shift arm 86 may include a detent to deter or prevent accidental or unintentional movement between the shift arm 86 and the ring gear 294. With continued reference to FIG. 7, the cover 533 may further include a first magnet 545 located on or embedded in the proximal side thereof, and the shift arm 86 may include a second magnet 547 located on or embedded in the distal side thereof. The first and second magnets 545, 547 may have opposite polarities. In use, when the cover 533 is coupled to the base 74 over the pocket 89, the first magnet 545 may be disposed in close proximity to, and may partially overlap with, the second magnet 547. In particular, the first and second magnets 545, 547 may be of sufficient magnetic strength and may be disposed in sufficiently close proximity to each other so that the magnetic fields emanating from the first and second magnets 545, 547 may interact and palpably repel one another.

Figure 8A:
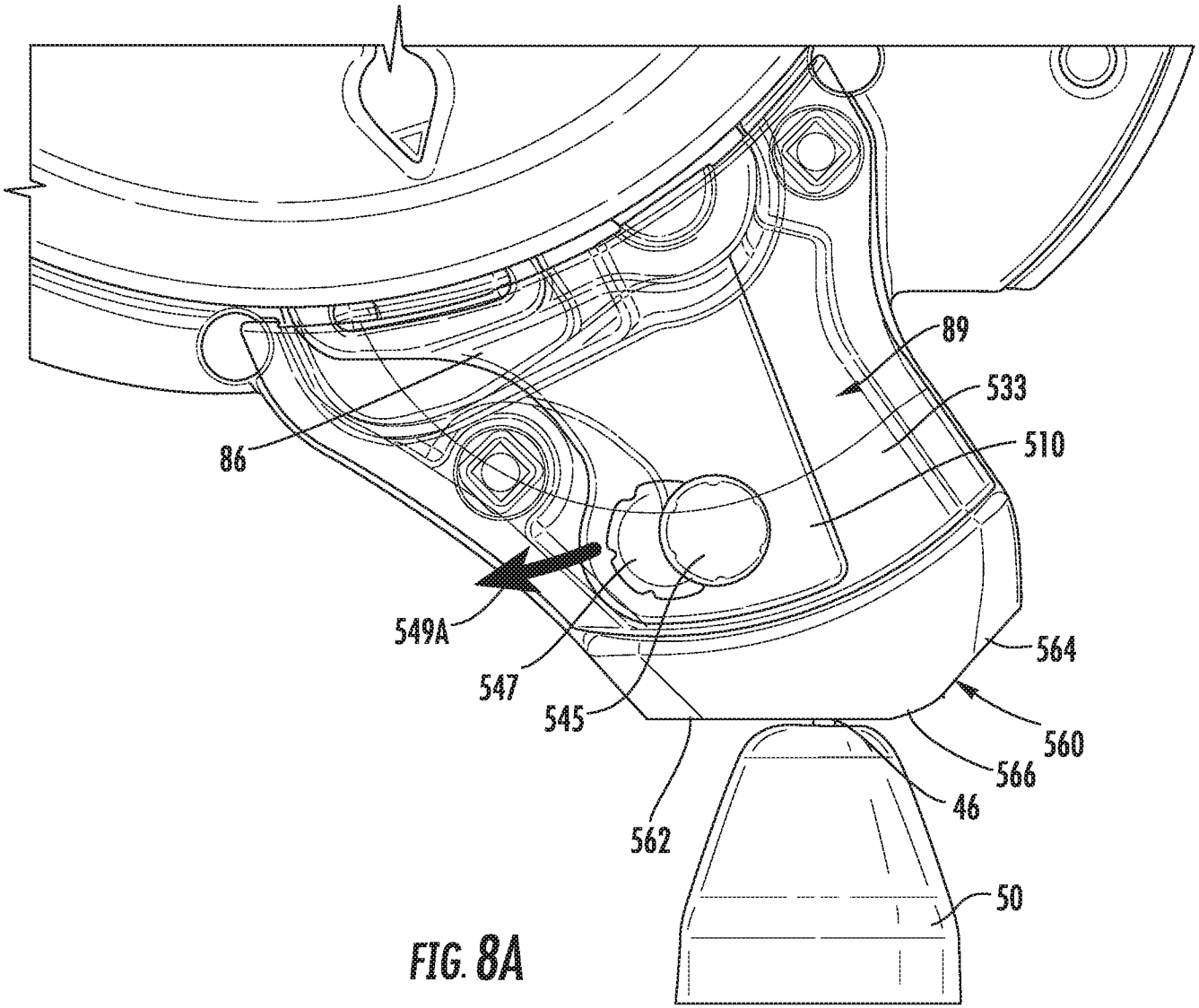
FIG. 8A is a partial, detailed view of the operating system shown in FIG. 2A illustrated in a retraction mode, the cover shown transparent for clarity of description.
Figure 8B:
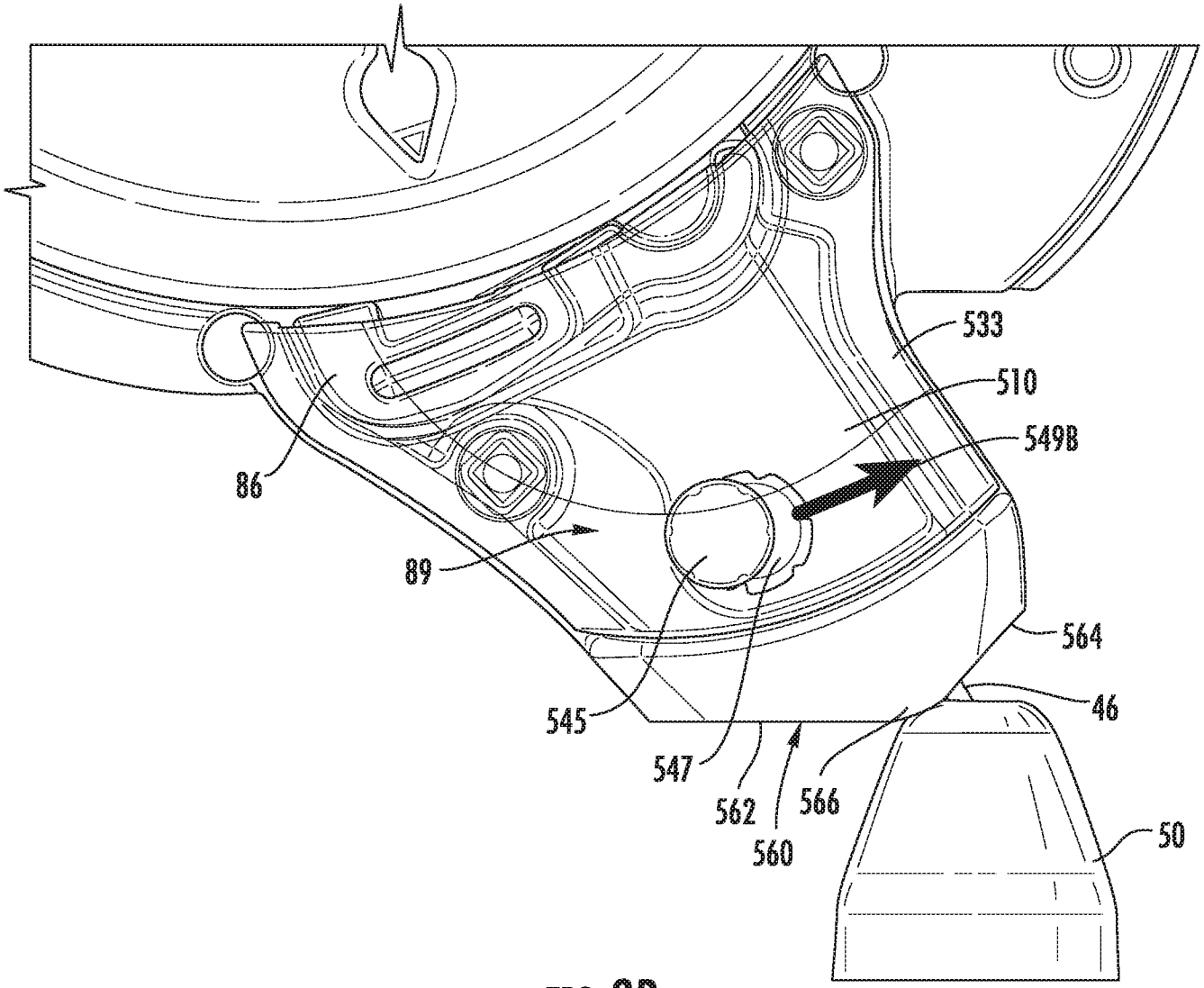
FIG. 8B is a partial, detailed view of the operating system shown in FIG. 2A illustrated in an extension mode, the cover shown transparent for clarity of description.

Referring to FIGS. 8A and 8B, in which the cover 533 is shown transparent for clarity of description, the second magnet 547 may, depending on the position of the shift arm 86, be positioned left of a magnetic center of the first magnet 545 (as in FIG. 8A) or right of the magnetic center the first magnet 545 (as in FIG. 8B). Thus, the repelling magnetic force between the first and second magnets 545, 547 may act as a detent to maintain the shift arm 86 in a desired position until a sufficient manual force is applied to the lever arm 510 (e.g., via the operating element 46 by the operator) to overcome the repelling magnetic force and move or pivot the shift arm 86 to the opposite position. For example, referring to FIG. 8A, the second magnet 547 may be positioned left of the magnetic center of the first magnet 545, and the repelling magnetic force between the first and second magnets 545, 547 may therefore bias the shift arm 86 in the direction indicated by the arrow 549A, toward the retraction mode. To shift the shift arm 86 to the extension mode, an operator may manipulate the operating element 46 to, for example, pivot the lever arm 510 forward with a sufficient manual force to overcome the repelling magnetic force between the first and second magnets 545, 547 until the second magnet 547 has been moved past the magnetic center of the first magnet 545. The second magnet 547 may thereafter be repelled in the opposite direction indicated by the arrow 549B in FIG. 8B, pivotably biasing the shift arm 86 toward the extension mode. The repelling force between the first and second magnets 545, 547 may be sufficient to retain the shift arm 86 in the extension mode against the force of gravity acting on the shift arm 86, and the operating element 46 until a sufficient manual force is applied to the lever arm 510 (e.g., via the operating element 46) to overcome the repelling magnetic force and move the shift arm 86 to the retraction mode.

With continued reference to FIGS. 8A and 8B, the housing extension portion 91 may include have a lower surface 560 including a substantially planar first surface 562 and a substantially planar second surface 564 meeting at a curved juncture 566. In use, the first surface 562 may be substantially horizontal, and an intersection of the plane of the first surface 562 and the plane of the second surface 564 may define an obtuse angle in a range of about 110 degrees to about 140 degrees, for example. The radius of curvature of the curved juncture 566 may be in a range from a sharp corner to about 8 millimeters, for example. In this manner, the curved juncture 566 obstructs forward movement of the operating element 46, and thus prevents the operating element 46 and hence the shift arm 86 from moving into the extension mode position accidentally via, for example, force of gravity without operator involvement.

That is, when the operating element 46 is disposed in the retraction mode position as shown in FIG. 8A, the operating element 46 may be positioned along the first surface 562. While the operating element 46 is held thusly, the curved juncture 566 may obstruct forward movement of the operating element 46, and thus prevent the operating element 46 and hence the shift arm 86 from moving into the extension mode position accidentally via, for example, force of gravity without operator involvement. That is, the operator may, through the application of manual force, shift the operating element 46 forward, past the curved juncture 566, and into the extension mode position however, the curved junction 566 prevents or renders more difficult the unintentional movement of the operating element 46 and hence the shift arm 86 into the extension mode position. As such, the contour of the lower surface 560 of the housing extension portion 91 may act as a passive detent for maintaining the operating element 46 in the retraction mode position until it is desired to move the operating element 46 to the extension mode position, and vice-versa.

In operation, the operating system 70 may be selectively switched between a retraction mode and an extension mode by manipulating the position of the shift arm 86. In one implementation, the operator may move the operating element 46 to transition the operating system 70 between the retraction mode and the extension mode, and vice-versa. Referring to FIG. 9A, in the retraction mode, the shift arm 86 is engaged with the ring gear 294 (e.g., projection 518 formed on the shift arm 86 engages or intermeshes with projections 474 formed on the ring gear 294 to prevent rotation and transfer of motion). To disengage the shift arm 86 from the ring gear 294, and thus transition the operating system 70 from the retraction mode to the extension mode, and hence alter the rotational direction of the rotatable member, the operator may move the operating element 46 in a direction, for example, the second direction, generally forward along the lower surface 560 of the housing extension portion 91. Since the operating element 46 is routed through the post 494, the lever arm 510, and the opening 542 of the shift arm 86, this forward movement of the operating element 46 pivots or moves the shift arm 86 radially away from the ring gear 294 to disengage the coupling arm 506 (e.g., projection 518) of the shift arm 86 from the ring gear 294 (e.g., projections 474 formed on the ring gear 294).

Referring to FIG. 9B, in the extension mode, the shift arm 86 may be disengaged from the ring gear 294. To engage the shift arm 86 with the ring gear 294, and thus transition the operating system 70 from the extension mode to the retraction mode, and hence alter the rotational direction of the rotatable member, the operator moves the operating element 46 in a direction, for example, the first direction, generally rearward along the surface 560 of the housing extension portion 91. Since the operating element 46 is routed through the post 494, the lever arm 510, and the opening 542 of the shift arm 86, this rearward movement of the operating element 46 pivots or rotates the shift arm 86 radially towards the ring gear 294 into engagement therewith, placing the operating system 70 in the retraction mode.

When the shift arm 86 is engaged with the ring gear 294 (e.g., the retraction mode), the operating system 70 permits the covering 22 to be raised or retracted. To raise or retract the covering 22, an operator pulls downward on the operating element 46. While pulling in a downward direction, the movement of the operating element 46 rotates the transmission 82, which rotates the rotatable member, causing the covering 22 to retract into the headrail. For example, with reference to FIGS. 4A and 4B, as described in greater detail in U.S. patent application Ser. No. 14/766,043 entitled "Operating System for A Covering for An Architectural Opening", in use, one end of the operating element 46 may be coupled to the spool 194 so that moving the operating element 46 rotates the spool 194, which in turn increases tensions in the spool spring 198. In addition, in the retraction mode, the clutch element 274 engages the sun gear 286, causing the sun gear 286 to rotate along with the spool 194. That is, in use, the clutch element 274 serves as a one-way clutch. During retraction, the clutch element 274 transfers torque from the spool 194 to the sun gear 286. Meanwhile, during extension, the clutch element 274 allows free rotation of the spool 194 relative to the sun gear 286. In one example embodiment as described in greater detail in U.S. patent application Ser. No. 14/766,043, the clutch element 274 may selectively engage the sun gear 286 depending on the direction of rotation (e.g., during retraction, arms formed on the clutch element 274 may expand to engage an inner surface of the sun gear 286 while during extension, arms formed on the clutch element 274 may contract to disengage from the sun gear 286,).

In the retraction mode, the ring gear 294 is prevented from rotating by the engagement of the shift arm 86 with the outwardly directed teeth 474 of the ring gear 294. With the ring gear 294 rotationally locked, rotation of the sun gear 286 causes the planet gears 290 to orbit around the sun gear 286, which in turn causes the planet carrier 298 to rotate. As the planet carrier 298 is coupled to the rotatable member, rotation of the planet carrier 298 rotates the rotatable member, retracting the covering 22. At the end of the downward stroke, the operator releases the operating element 46 and the spool spring 198 correspondingly reels in the operating element 46 around the groove 218 of the spool 194. As the operating element 46 is retracted, the clutch element 274 isolates the sun gear 286 from the rotation of the spool 194. Additionally, the operating system 70 prevents the rotatable member from rotating in a shade extension direction, thereby maintaining the position of the covering 22 relative to the architectural opening during the intermittent retraction of the operating element 46. In one implementation, the sun gear 286 is rotationally locked to the stationary axle 278 in the shade extension direction by at least one wrap spring 282 and the ring gear 294 is rotationally locked by the shift arm 86. Thus, in this implementation, the sun gear 286 and the ring gear 294 prevent the planet gears 298 from orbiting about the sun gear 286, thereby inhibiting extension of the covering 22 across the opening when the operating system 70 is in the retraction mode. Therefore, even though the spool 194 can rotate and reel in the operating element 46, the operating system 70 holds the covering 22 in place. In this fashion, the operator can cyclically move the operating element 46 as many times as necessary to raise or retract the covering 22 a desired distance, causing the spool 194 to reciprocate rotationally back and forth and the sun gear 286 to incrementally advance forward in a winding direction.

To transition the operating system 70 into the extension mode to extend or lower the covering 22, the operator moves the operating element 46 in a direction, for example, generally forward along the surface 560 of the housing extension portion 91. This movement of the operating element 46 transitions the operating system 70 from the retraction mode to the extension mode, and hence causes the shift arm 86 to move away from and thus to disengage from the ring gear 294. During this operation, the operator may feel and/or hear an audible click as the ring gear 294 is released.

Once the shift arm 86 is disengaged from the ring gear 294, the fixed orientation of the rotatable member may be released, allowing the covering 22 to unwind and lower by gravity or any other downward biasing element (such as, for example, a supplemental spring). The repelling magnetic force between the first and second magnets 545, 547, and/or the surface 560 of the housing extension portion 91, maintains the shift arm 86 in the shade extension mode, allowing the operator to release the operating element 46 and no longer monitor the architectural-structure covering 10 as the covering 22 is lowering. Generally, the covering 22 will lower regardless of handling nuances of the operator of the operating element 46, such as holding or releasing the operating element 46. To stop the extension or lowering of the covering 22, the operator may shift the operating system 70 into the retraction mode by moving the shift arm 86 into engagement with the ring gear 294 (e.g., moving the operating element 46 in a direction generally rearward along the surface 560 of the housing extension portion 91).

As previously mentioned, in one implementation, the covering 22 may be wrapped about or unwrapped from a rear side of the rotatable member, with the rear side of the rotatable member positioned intermediate the front side of the rotatable member and a street side of an associated architectural structure. Alternatively, in an alternate embodiment, the covering 22 may be wrapped about or unwrapped from a front side of the rotatable member.

Figure 10:
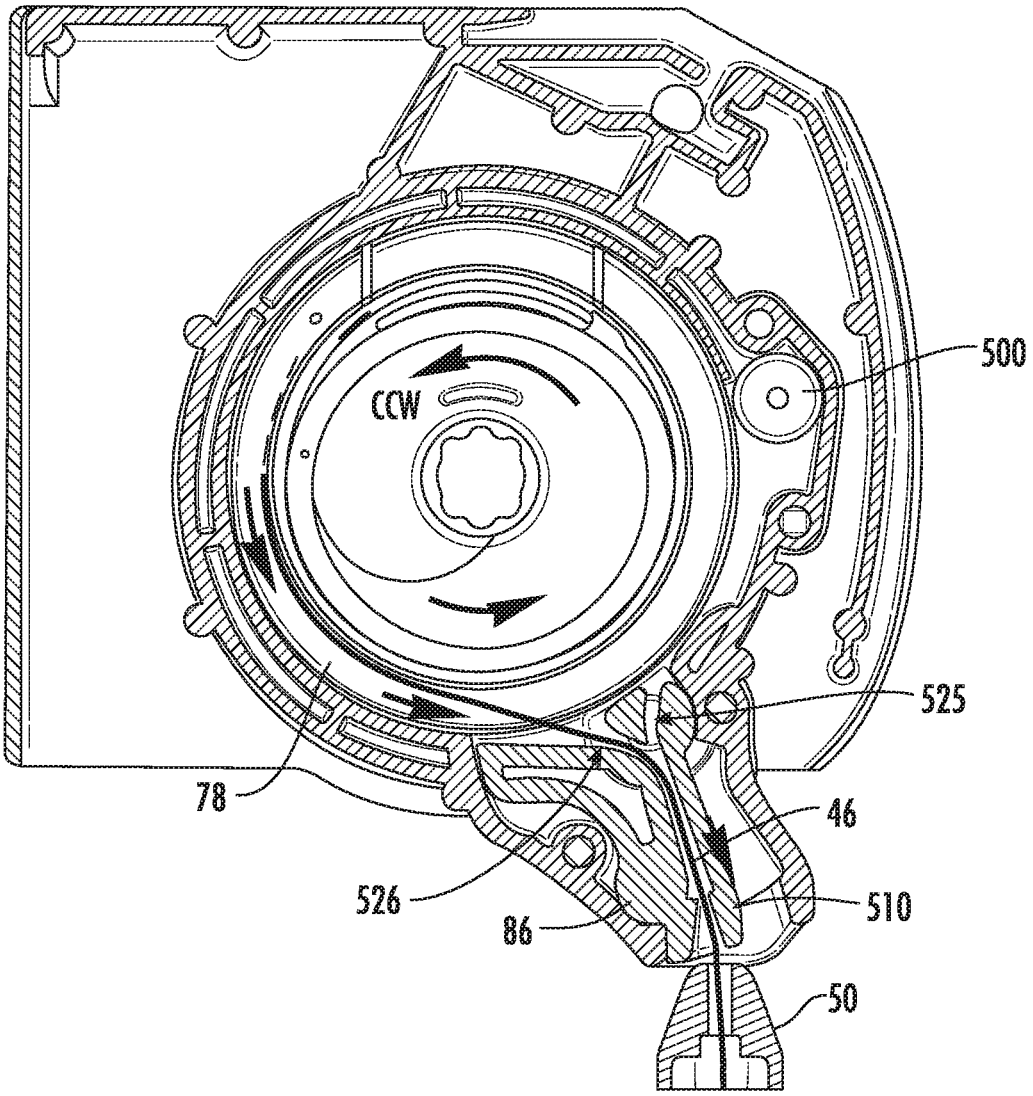
FIG. 10 is a partial, detailed view of the operating system shown in FIG. 2A with the operating element routed through a secondary channel for enabling reverse rotation of the rotatable member.
Figure 11:
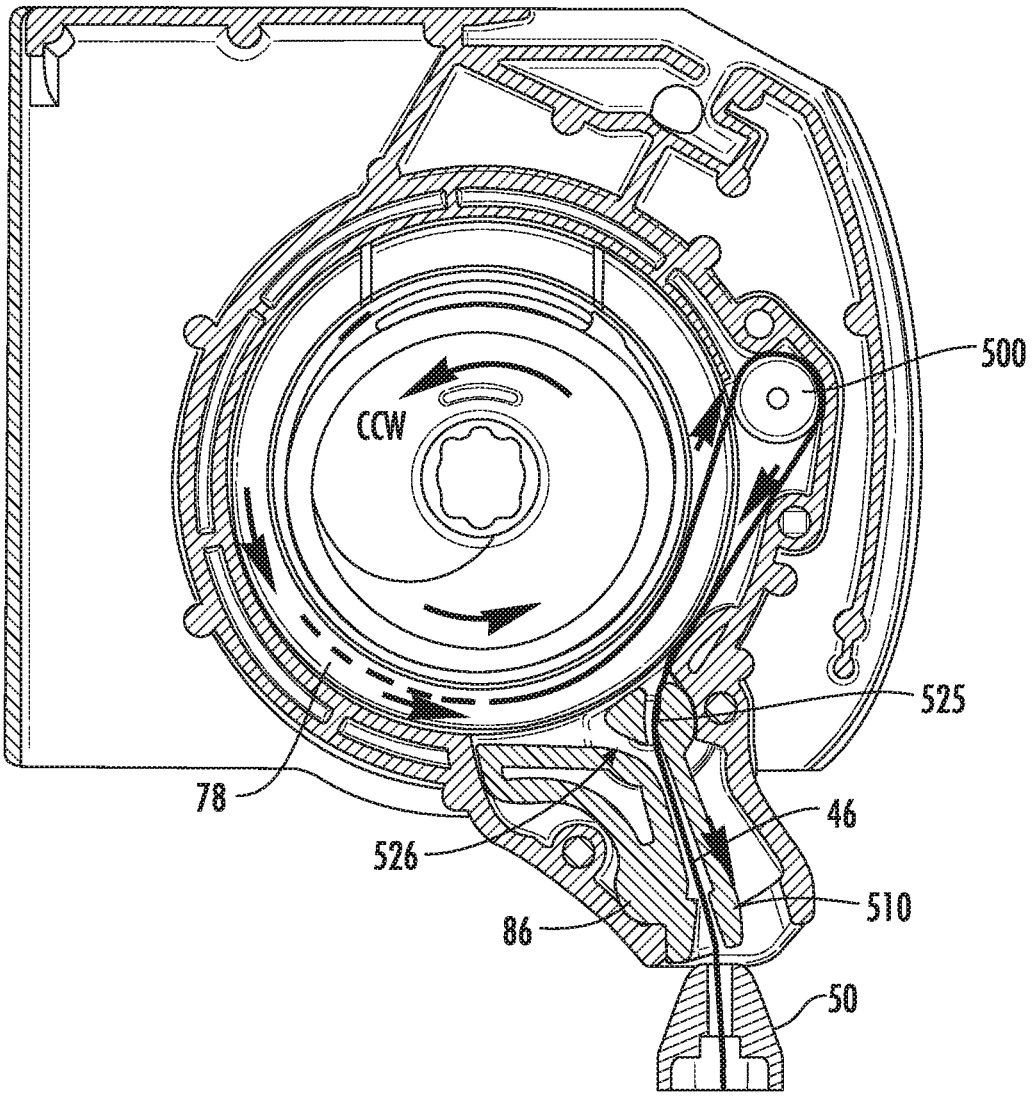
FIG. 11 is a partial, detailed view of the operating system shown in FIG. 2A with the operating element routed past a pulley for enabling reverse rotation of the rotatable member.

As such, as illustrated in FIG. 6, movement of the operating element 46 may result in clockwise rotation CW of the drive mechanism 78 (e.g., spool assembly). Alternatively, referring to FIG. 10 by rerouting the operating element through the lever arm 510 of the shift arm 86 so that the operating element 46 passes through a secondary channel or pathway 526 formed to a side of the post 494, the operating system 70 is easily adaptable to enable counter-clockwise rotation CCW of the drive mechanism 78 (e.g., spool assembly). Alternatively, referring to FIG. 11, the operating system 70 may include a pulley 500. By incorporating the pulley 500, the operating element 46 is able to be routed through the pathway or channel 525 formed through the post 494. In this embodiment, movement of the operating element 46 results in counter-clockwise rotation CCW of the drive mechanism 78 (e.g., spool assembly). By incorporating the pulley 500, substantially the same operating system 70 can be used regardless if clockwise or counter-clockwise rotation of the rotatable member is desired.

The foregoing description has broad application. For example, while the provided examples include a transmission having a planetary gear set, it should be appreciated that the concepts disclosed herein may equally apply to any type of transmission, regardless of whether the transmission includes a gear reduction. For instance, some transmissions used by the operating system may not include a planetary gear set, such as in applications for small-sized window coverings. Thus, it should be appreciated that the actuator mechanism may engage any type of transmission device. Further, the input and output components of the planetary gear set may vary depending on the window covering application. Moreover, although wrap springs and one type of clutch element have been discussed, other suitable brake and/or clutch elements may be used. Additionally, the example operating system may be used with any type of shade, including, but not limited to, roller and stackable shades. Furthermore, the example operating module or system may be used in association with either end of a head rail. For example, although the illustrated operating module may be configured for association with a right-hand side of a covering, an operating module configured for association with a left-hand side of the covering may be provided and may be a mirror image of the illustrated module. Accordingly, the discussion of any embodiment is meant only to be explanatory and is not intended to suggest that the scope of the disclosure, including the claims, is limited to these examples. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

The invention claimed is:

1. An architectural-structure covering comprising:

a rotatable member rotatable about a longitudinal axis in an extension direction and a retraction direction;

a covering portion;

a base; and an operating system operably associated with said rotatable member, the operating system comprising:

a transmission to selectively transmit an input torque to said rotatable member;

a shift arm for selectively engaging said transmission for transitioning said operating system between a retraction mode and an extension mode, said shift arm being pivotably coupled to said base; and an operating element operable to supply said input torque, and for selectively transitioning said shift arm between said retraction mode and said extension mode;

wherein said shift arm is movable in one of a first direction and a second direction for transitioning said operating system between said retraction mode and said extension mode;

wherein said first and second directions are transverse to a longitudinal axis of the architectural-structure covering;

wherein said base includes a lower surface and an opening passing through said lower surface, said operating element passing through said opening;

said lower surface including a first surface arranged and configured to interact with a portion of said operating element in one of said retraction mode and said extension mode, a second surface arranged and configured to interact with said portion of said operating element in the other one of said retraction mode and said extension mode, and a junction connecting said first and second surfaces, said junction adapted and configured to resist movement of said operating element between said first and second surfaces, said junction defined by an obtuse angle between a major length of the first surface and a major length of the second surface.

2. The covering of claim 1, wherein said first direction is one of a forward or rearward direction with respect to an operator positioned in front of said covering portion, said second direction is said other one of said forward or rearward direction.

3. The covering of claim 1, wherein in said retraction mode, said shift arm engages said transmission to prevent rotation of said rotatable member in said extension direction.

4. The covering of claim 3, wherein in said extension mode, said shift arm is disengaged from said transmission to permit rotation of said rotatable member in said extension direction.

5. The covering of claim 1, wherein said shift arm includes a projection for engaging said transmission when said shift arm is in said retraction mode.

6. The covering of claim 5, wherein said transmission includes a ring gear including one or more projections, said projection formed on said shift arm intermeshing with said one or more projections formed on said ring gear in said retraction mode to prevent rotation of said ring gear.

7. The covering of claim 6, wherein, when said shift arm is in said extension mode, said projection formed on said shift arm is spaced from said one or more projections formed on said ring gear to permit rotation of said ring gear.

* * * * *